US009623946B2

(12) United States Patent
DeLise, Sr.

(10) Patent No.: US 9,623,946 B2
(45) Date of Patent: Apr. 18, 2017

(54) INBOARD/OUTBOARD WITH PORTABLE OUTDRIVE

(71) Applicant: Stephen W. DeLise, Sr., Palm City, FL (US)

(72) Inventor: Stephen W. DeLise, Sr., Palm City, FL (US)

( * ) Notice: Subject to any disclaimer, the term of this patent is extended or adjusted under 35 U.S.C. 154(b) by 0 days.

(21) Appl. No.: 14/643,019

(22) Filed: Mar. 10, 2015

(65) Prior Publication Data

US 2016/0096607 A1 Apr. 7, 2016

Related U.S. Application Data

(60) Provisional application No. 62/060,698, filed on Oct. 7, 2014.

(51) Int. Cl.

| | |
|---|---|
| ***B63H 20/02*** | (2006.01) |
| ***B63H 20/00*** | (2006.01) |
| ***B63H 20/06*** | (2006.01) |
| ***B63H 20/12*** | (2006.01) |
| ***B63H 20/16*** | (2006.01) |
| *B63B 35/00* | (2006.01) |
| *B63H 9/04* | (2006.01) |

(52) U.S. Cl.

CPC ..... *B63H 20/007* (2013.01); *B63H 20/06* (2013.01); *B63H 20/12* (2013.01); *B63H 20/16* (2013.01); *B63B 2035/009* (2013.01); *B63H 9/04* (2013.01); *B63H 2020/025* (2013.01)

(58) Field of Classification Search

CPC ..... B63H 20/007; B63H 20/20; B63H 5/125

See application file for complete search history.

(56) References Cited

U.S. PATENT DOCUMENTS

| | | | | |
|---|---|---|---|---|
| 1,780,075 | A | 10/1930 | Griffith | |
| 1,802,351 | A | 4/1931 | Neumann | |
| 2,486,574 | A | 11/1949 | Roof | |
| 2,923,270 | A * | 2/1960 | Travis, Sr. | B63H 20/10 440/64 |
| 3,998,177 | A * | 12/1976 | Rhodes | B63H 11/08 440/40 |
| 4,501,562 | A | 2/1985 | Blanchard | |
| 4,527,983 | A * | 7/1985 | Booth | B63H 20/007 114/153 |
| 4,781,633 | A | 11/1988 | Hunt | |
| 5,755,604 | A | 5/1998 | Borgersen | |
| 5,816,870 | A | 10/1998 | Rubin | |
| 6,616,489 | B1 * | 9/2003 | Dompierre | A01D 34/416 440/49 |
| 7,201,621 | B2 * | 4/2007 | Jones | B63H 19/06 114/151 |
| 8,425,268 | B2 | 4/2013 | Daikoku et al. | |

* cited by examiner

*Primary Examiner* — Andrew Polay

(74) *Attorney, Agent, or Firm* — Keusey & Associates, P.C.

(57) ABSTRACT

An apparatus for propelling a water craft including an outboard propulsion assembly having a removable configuration that can be mounted and demounted by hand without tools and a portable size so that it can be carried by an individual.

8 Claims, 8 Drawing Sheets

FIG. 2
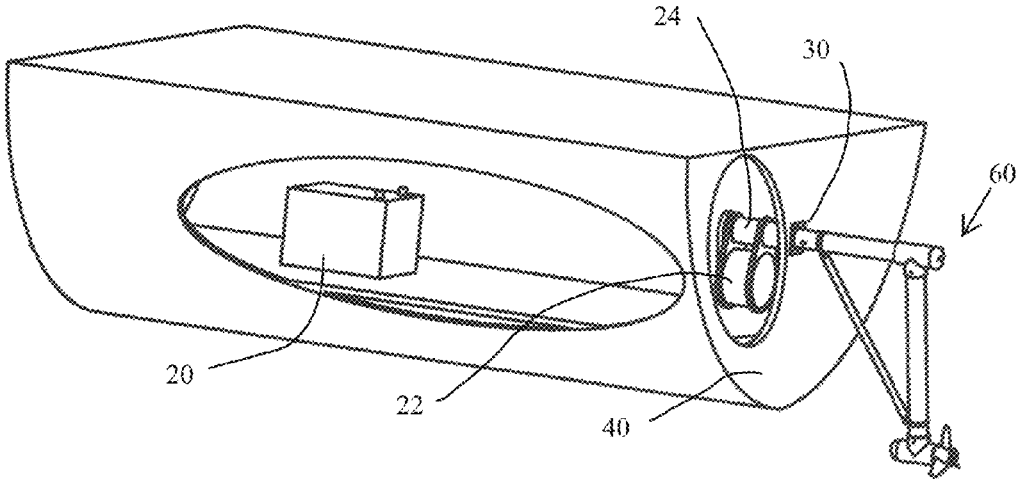
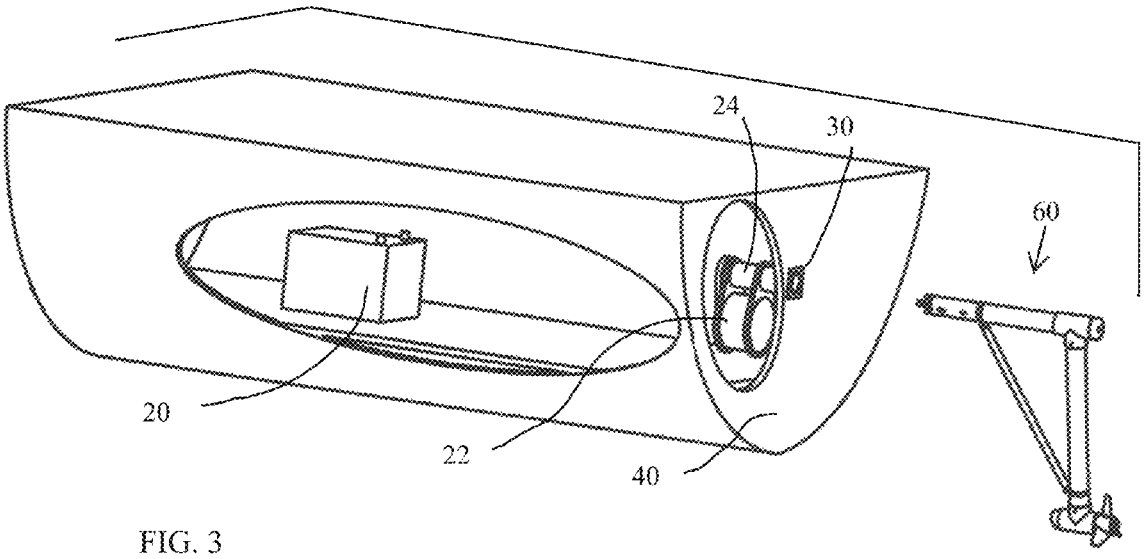
FIG. 3

FIG. 5
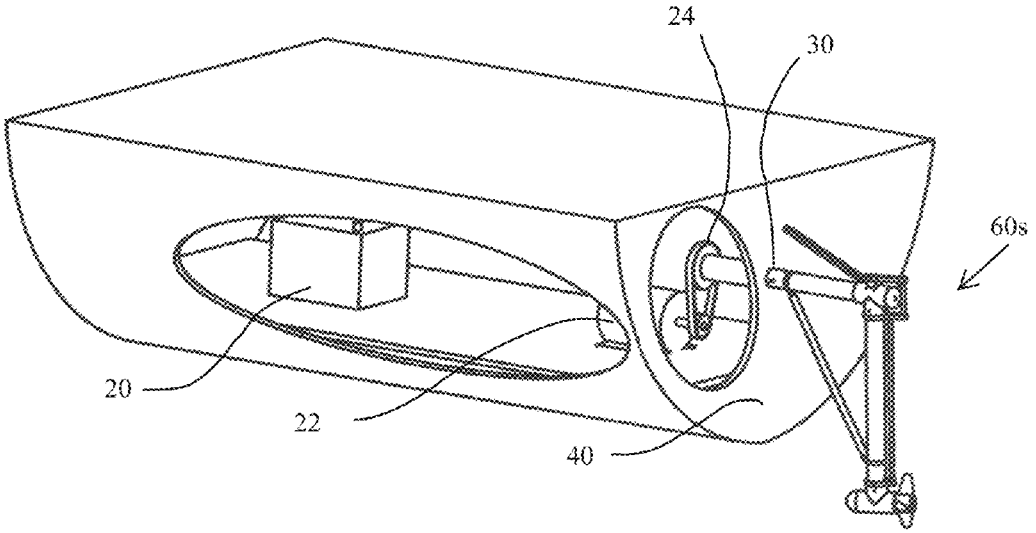
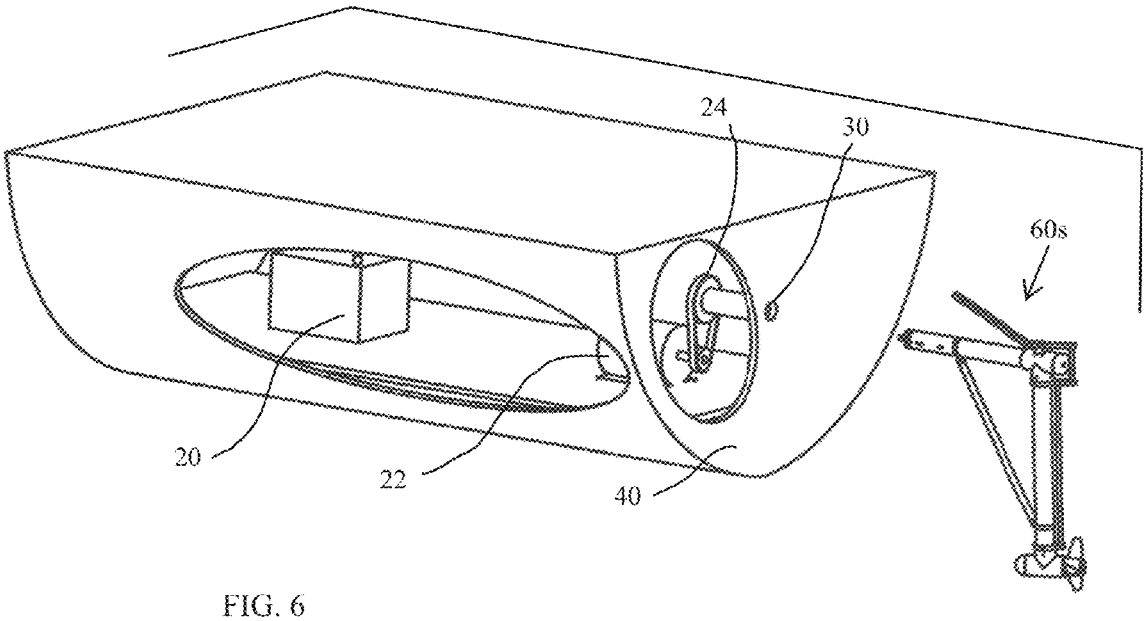
FIG. 6

FIG. 8
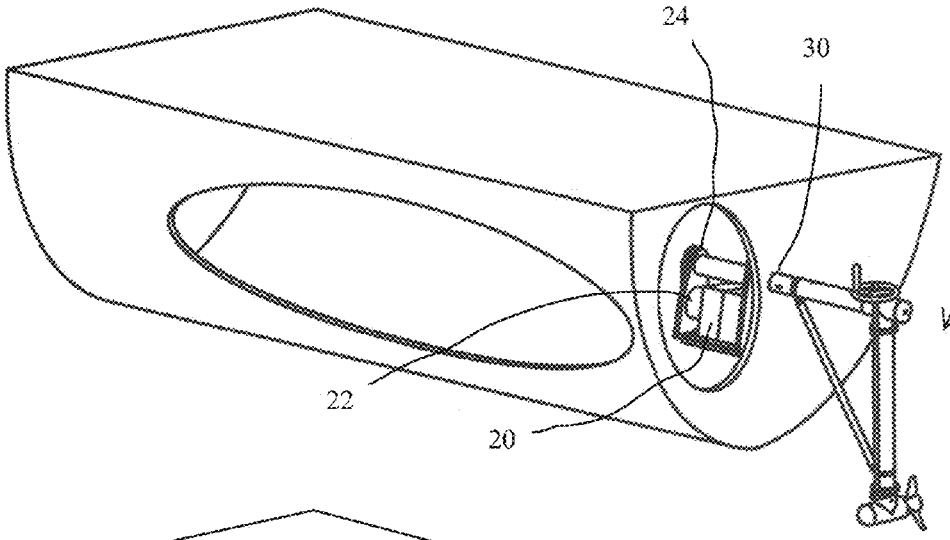
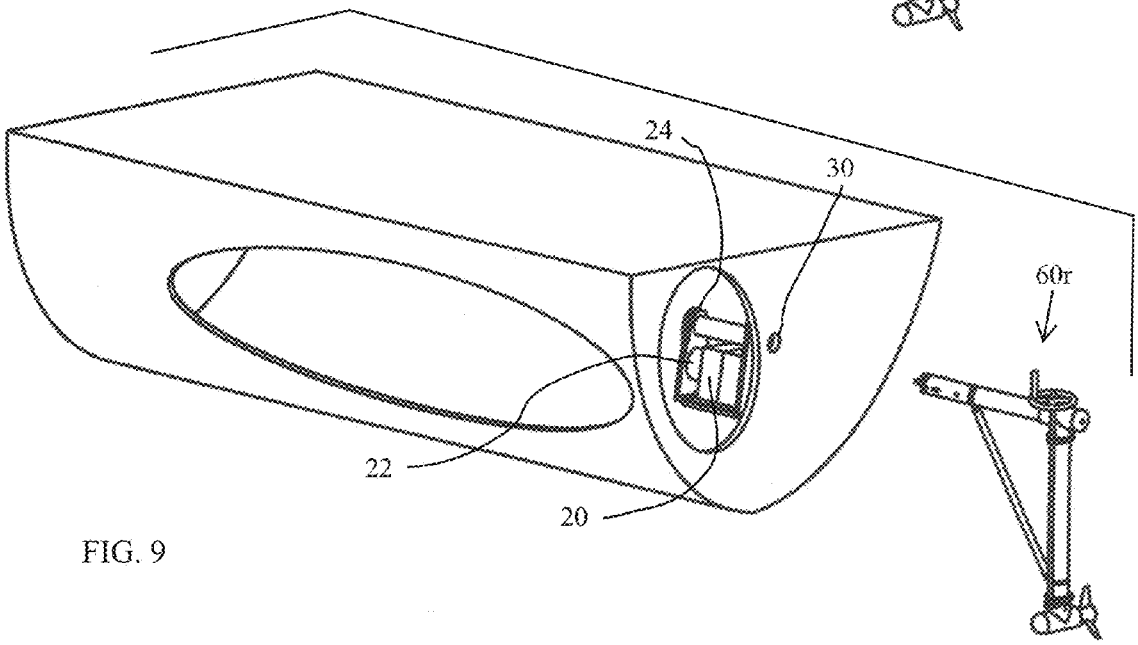
FIG. 9

INBOARD/OUTBOARD WITH PORTABLE OUTDRIVE

CROSS-REFERENCE TO RELATED APPLICATIONS

This application claims the benefit under 35 U.S.C. §119(e) from U.S. Provisional Patent Application No. 62/060,698 entitled INBOARD/OUTBOARD WITH REMOVABLE OUTDRIVE filed Oct. 7, 2014.

BACKGROUND OF THE INVENTION

1. Field of the Invention

The invention relates to an inboard/outboard with portable outdrive.

2. The Prior Art

In certain instances it is desirable to equip small watercraft with a propulsion system. For example, it would be convenient to deploy a powered drive on a sailboat if there is no wind, or in tight quarters. However, the presence of such propulsion systems is undesirable and unattractive when the boat is under sail.

U.S. Pat. No. 4,501,562 describes a transom bracket that allows a marine propulsion unit to be retracted when not in use. For example, FIG. 1 shows the marine propulsion unit in position for use. FIG. 2 shows the motor pivoted out of the water, while FIG. 5 shows the motor slid up out of the water. The transom bracket allows a conventional heavy motor to be translated through several positions while remaining on the transom at all times.

U.S. Pat. No. 5,816,870 describes an electric drive system for launches and sailboats. It does not specify how the drive system is mounted or if it is removable. U.S. Pat. No. 8,425,268 describes an outboard motor that is modularly connected to a battery power source. However, the motor is part of the outboard module, making it heavy and difficult to remove.

Accordingly, it would be desirable to provide a portable, lightweight outdrive that can be mounted and demounted by hand without the use of tools.

SUMMARY OF THE INVENTION

It is an object of the present invention to provide an outdrive propulsion unit that can be attached and removed from a boat-mounted coupling by hand without the use of tools.

It is a further object to make the outdrive propulsion unit lightweight so it can be portably carried by one person for stowage on or off the boat.

The key aspects of the invention relate to a portable drive system including a hand operated coupling system mounted on a boat transom.

It is a further object to provide steering options on the removable outdrive.

More particularly, the invention relates to an apparatus for propelling a water craft having an outboard propulsion assembly with removable configuration that can be mounted and demounted by hand without tools and a portable size so that it can be carried by an individual.

The removable configuration includes a quick-connect and quick-disconnect coupling. The coupling comprises a socket on the water craft and a mating plug on the outboard propulsion assembly. The plug and socket is the only connection between the water craft and the outboard propulsion unit. The mating plug is mounted to the water craft by plugging into the socket with a sliding motion in the axial direction. The coupling includes a simple hand-operated latching device.

The apparatus further includes a drive unit attached to the coupling. The drive unit includes a battery and motor combined with the coupling in a self-contained package. The drive unit is inboard of the coupling. The drive unit is selected from the group consisting of a gas powered drive unit, a diesel powered drive unit and a battery powered drive unit. A tiller pivots the outboard propulsion assembly to selectively vary the direction of thrust. A steering wheel rotates the outboard propulsion assembly to selectively vary the direction of thrust. A bracket is mounted on the water craft transom, and means for pivoting the socket with respect to the bracket so that the propulsion unit can be raised and lowered.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views:

FIG. 2 is a perspective view of a boat hull with partial cut-away showing an embodiment of a removable drive system connected to the transom-mounted coupling.

FIG. 3 is a perspective view of a boat hull with partial cut-away showing the removable, and now portable, drive system disconnected from the transom-mounted coupling.

FIG. 5 is a perspective view of a boat hull with partial cut-away showing an embodiment of a steerable drive system connected to the transom-mounted coupling.

FIG. 6 is a perspective view of a boat hull with partial cut-away showing the steerable, and now portable, drive system disconnected from the transom-mounted coupling.

FIG. 8 is a perspective view of a boat hull with partial cut-away showing an embodiment of a rotating drive system connected to the transom-mounted coupling.

FIG. 9 is a perspective view of a boat hull with partial cut-away showing the rotating, and now portable, drive system disconnected from the transom-mounted coupling.

DETAILED DESCRIPTION OF THE PREFERRED EMBODIMENT

The invention relates to a configuration where only a portable propulsion unit is located outboard of the transom. This outboard assembly is lightweight and can easily be unplugged and removed by hand when not in use. The heavy battery and motor are located inboard of the transom and can be permanently or temporarily mounted. A coupling provides an easy way to connect and remove the removable propulsion unit by hand from the internal power source.

Figure 1:
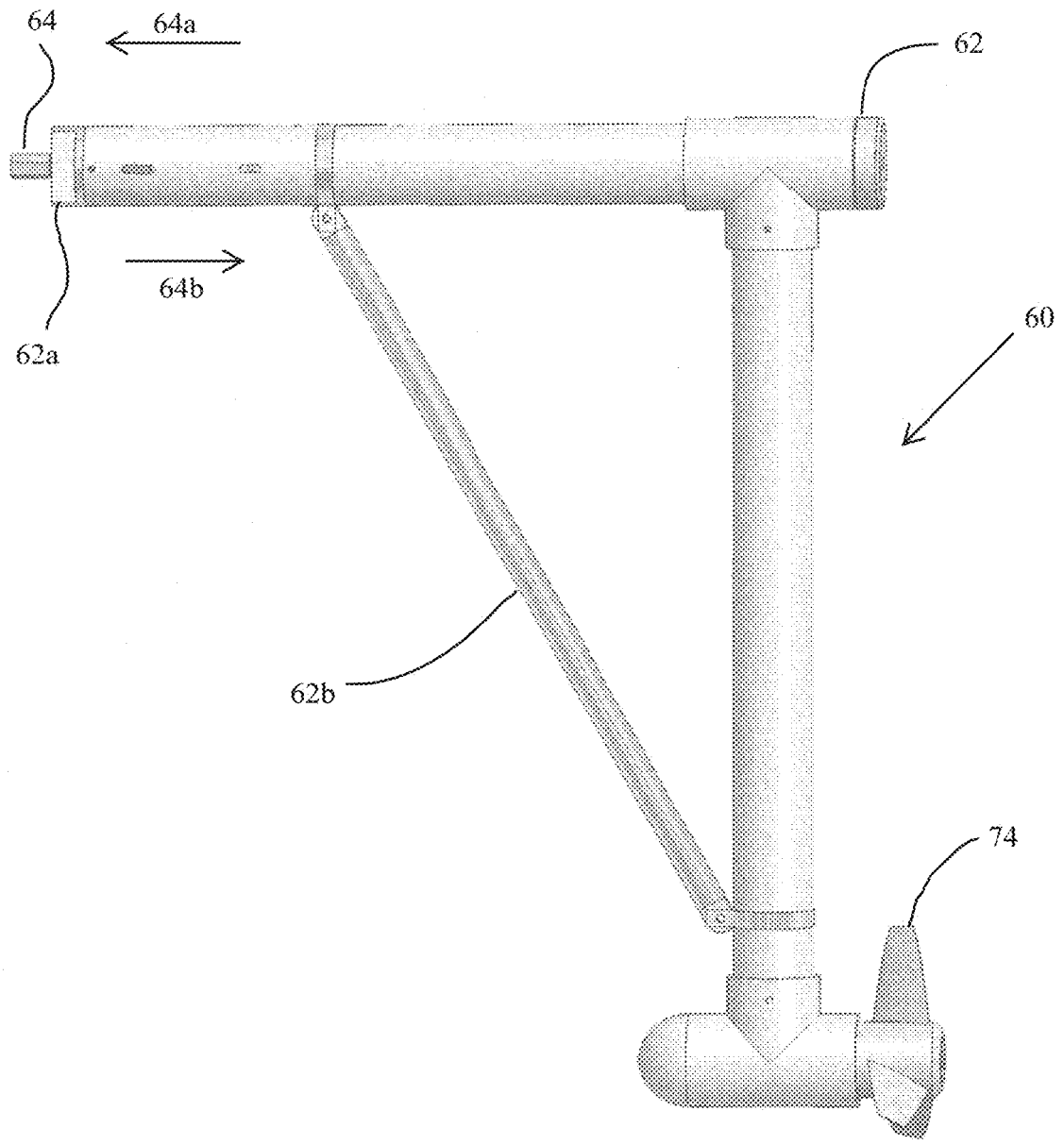
FIG. 1 is a right side elevational view of a straight removable drive.

FIG. 1 shows a portable propulsion assembly 60 having as primary features an input shaft 64 that drives a thrusting device, shown as a propeller 74 for illustrative purposes.

Input shaft may be operatively coupled to propeller my any known drive means or linkages. For example input shaft may extend outwardly and drive belts that extend downwardly to a propeller shaft. The drive means are contained within a housing 62 having a coupling member 62*a* adjacent input shaft 64. Coupling member 62*a* is slid in a axial direction 64*a* to install the propulsion unit for use. Coupling member 62*a* is then slid in the opposite axial direction 64*b* to remove the propulsion unit to make it portable. A brace 62*b* may be provided to support the housing.

As can be seen in FIGS. 2 and 3, the invention provides a coupling unit 30 mounted on, and extending through, a boat transom 40. Inboard of the transom, a battery 20 powers a motor 22 coupled to a drive unit 24. The drive unit 24 may be a shaft directly driven by a power source or indirectly coupled via a transmission source. In this instance, FIGS. 2 and 3 show a motor coupling attached to the drive unit on the inboard side of coupling 30.

In FIG. 2 the propulsion assembly is attached to coupling unit 30, where the propeller can be rotated by motor 22 and drive unit 24. When the boat is under sail, propulsion assembly 60 can be disconnected from coupling unit 30, as shown in FIG. 3 and stowed. The removal of the propulsion assembly is achieved by sliding it in axial direction 64*b* by hand. Removing propulsion unit eliminates the drag and unattractiveness associated with propulsion units on sailboats. The propulsion unit is designed with a low weight so it can be pulled on loud by one person. The propulsion unit can then be carried to any suitable storage location.

Coupling member 62*a* has a plug that fits into a mating socket provided on coupling unit 30. To secure the plug in the socket, a simple hand operated latching device is provided. This may take the form of a clip or spring-loaded latch on either the plug or socket that can be unclipped by manual manipulation, The latch allows housing 62 to remain stationary, while input shaft 64 drives propeller 74 internally.

Figure 4:
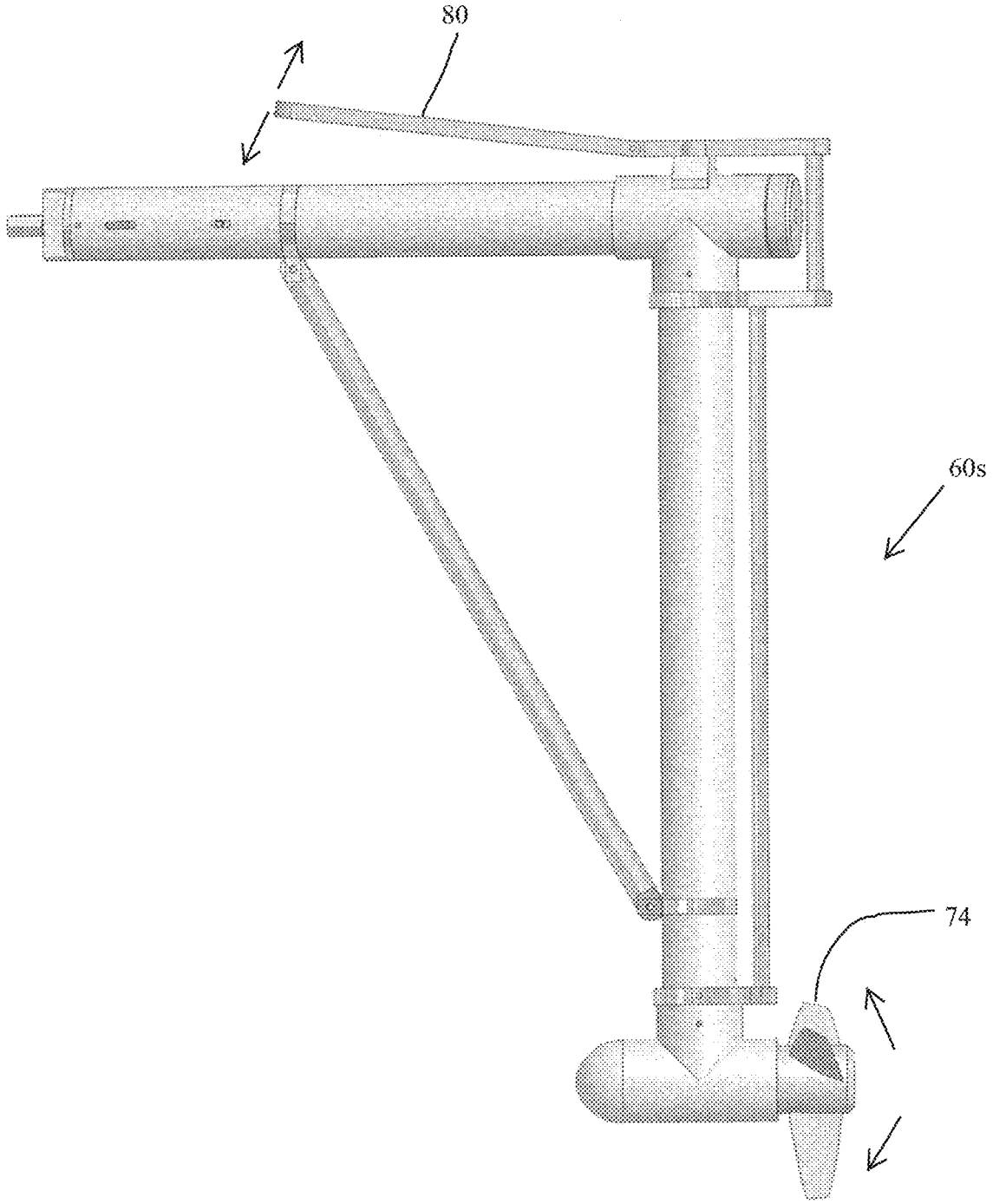
FIG. 4 is a right side elevational view of a steerable drive.

FIG. 4 illustrates an alternate embodiment in the form of a steerable propulsion assembly 60*s*. A tiller 80 is pivotally mounted to effect angular rotation of the downwardly extending housing section thereby altering the direction of propeller 74. FIGS. 5 and 6 show how the steerable propulsion assembly 60*s* plugs into and out of the coupling unit 30 in the same manner as the propulsion assembly of FIGS. 1-3. In this embodiment, motor 22 is mounted to the bottom deck of the boat. Either motor mount can be used with either propulsion assembly.

Figure 7:
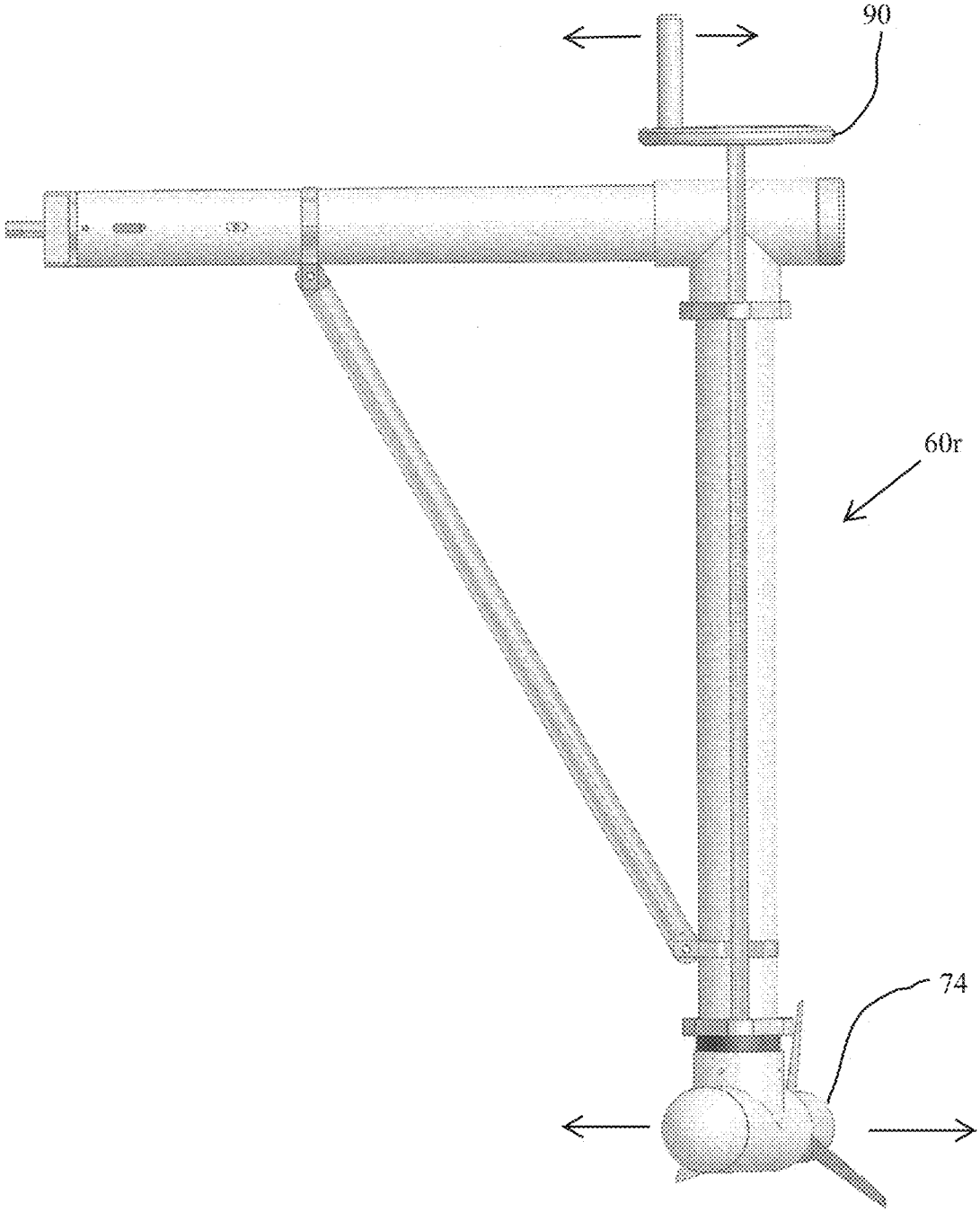
FIG. 7 is a right side elevational view of a rotating drive.

FIG. 7 illustrates an alternate embodiment in the form of a rotating propulsion assembly 60*r*. A steering wheel 90 is mounted to effect angular rotation of the downwardly extending housing section thereby altering the direction of propeller 74. FIGS, 8 and 9 show how the rotating propulsion assembly 60*r* plugs into and out of the coupling unit 30 in the same manner as the propulsion assembly of FIGS. 1-3. In this embodiment, battery 20, motor 22 and drive unit 24 are combined in a power pack. Either motor configuration can be used with either propulsion assembly.

Figure 10:
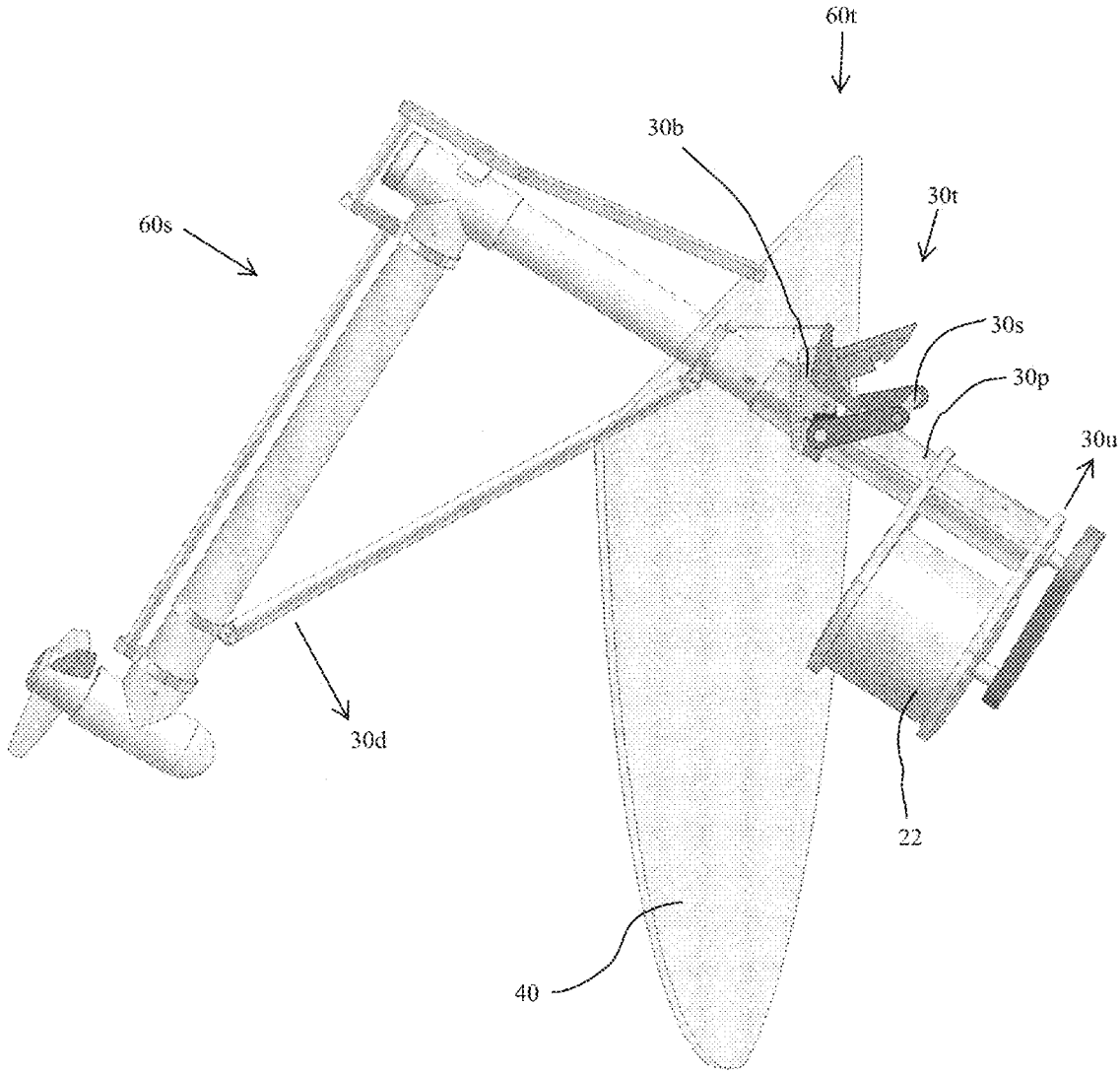
FIG. 10 is a perspective view of a boat transom section with a tiltable coupling shown in the tilted up position.
Figure 11:
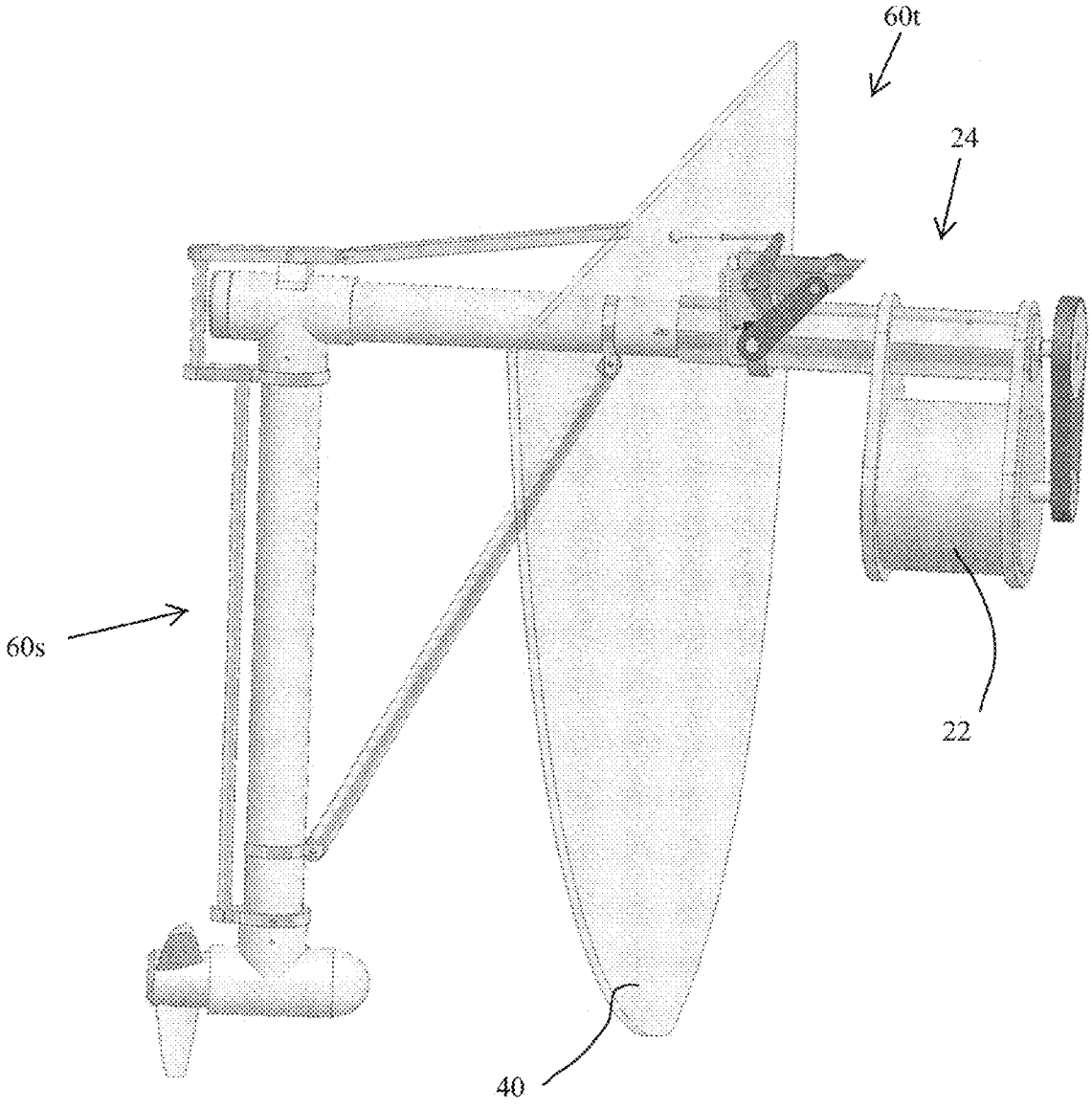
FIG. 11 is a perspective view of a boat transom section with a tiltable coupling shown in the down and locked position.

Referring now to FIGS. 10 and 11, there is shown a tiltable coupling unit 30*t*. In prior embodiments, the coupling unit is fixedly mounted on the transom. In this embodiment, a tiltable coupling unit 30*t* is pivotally mounted on the transom 40. More specifically, tiltable coupling unit 30*t* includes a bracket 30*b* mounted on transom 40 having a catch, and a pivoting section 30*p* having a striker 30*s*. Various other mechanical means can be employed to latch the tillable coupling unit in place.

A motor 22 is mounted directly on pivoting section 30*p*, which provides a counter weight. From the operational configuration of FIG. 11, the catch can be released and motor 22 will pivot drive unit 24 downwardly, thereby pulling propulsion assembly 60*s* upwardly, to the configuration shown in FIG. 10. When it is desired to drop the propulsion unit into the water, the motor is lifted up by hand pivoting coupling unit upward 30*u* and propeller downward in direction 30*d*. When the coupling unit is full pivoted, the striker 30*s* engages in the catch, in the configuration shown in FIG. 11. While steerable propulsion unit 60*s* is shown, either propulsion unit 60 or rotating propulsion unit 60*r* can be used interchangeably with the tiltable coupling unit 30*t*.

The propulsion unit includes a plug that can be axially plugged and removed from a socket located within tiltable coupling unit 30*t*. In other words, the plug and socket concept is present in all embodiments, whether straight drive, steerable drive or rotating drive. The socket may be fixed or pivotable. The motor may be mounted on a boat deck, on the coupling unit, or other suitable location.

Having described preferred embodiments for (which are intended to be illustrative and not limiting), it is noted that modifications and variations can be made by persons skilled in the art in light of the above teachings. It should be understood that propulsion assembly can take many varied forms, and is not limited to the specific embodiment shown and described. While a latter and electric motor are shown, it should be understood that other power sources can be employed within the scope of the invention. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An apparatus for propelling a water craft having a transom comprising:

an inboard drive unit that rotates a quick-connect and quick-disconnect coupling that extends through the transom; and an outboard propulsion assembly for propelling the water craft that can be mounted and demounted to said coupling by hand without tools and having a portable size so that it can be carried by an individual; and wherein said coupling comprises a socket and said outboard propulsion unit includes a mating plug, wherein the plug and socket is the only connection between the water craft and said outboard propulsion assembly.

2. The apparatus of claim 1, wherein said mating plug is mounted to the water craft by plugging into said socket with a sliding motion in an axial direction.

3. The apparatus of claim 1, further comprising a hand-operated latch for securing a housing of said outboard propulsion assembly to said transom.

4. The apparatus of claim 1, wherein said drive unit includes a battery and motor combined with said coupling in a self-contained package.

5. The apparatus of claim 1, wherein said drive unit is selected from the group consisting of a gas powered drive unit, a diesel powered drive unit and a battery powered drive unit.

6. The apparatus of claim 1, further comprising a tiller to pivot said outboard propulsion assembly and selectively vary the direction of thrust.

7. The apparatus of claim 1, further comprising a steering wheel to rotate said outboard propulsion assembly and selectively vary the direction of thrust.

8. The apparatus of claim 1, wherein said coupling is pivotally mounted to the transom so that said mounted outboard propulsion assembly can be tilted.

* * * * *